US006086431A

United States Patent [19]

Konoya et al.

[11] Patent Number: 6,086,431

[45] Date of Patent: Jul. 11, 2000

[54] CONNECTOR

[75] Inventors: Hisashi Konoya; Hideto Nakamura, both of Yokkaichi, Japan

[73] Assignee: Sumitomo Wiring Systems, Ltd., Japan

[21] Appl. No.: 09/167,618

[22] Filed: Oct. 6, 1998

[30] Foreign Application Priority Data

Oct. 29, 1997 [JP] Japan ..... 9-297419

[51] Int. Cl.[7] ..... H01R 13/436

[52] U.S. Cl. ..... 439/752

[58] Field of Search ..... 439/752, 595

[56] References Cited

FOREIGN PATENT DOCUMENTS 4-137474 of 1992 Japan .
4-322079 of 1992 Japan .

*Primary Examiner*—Gary F. Paumen
*Attorney, Agent, or Firm*—Anthony J. Casella; Gerald E. Hespos; Michael J. Porco

[57] ABSTRACT

A retainer is provided to increase a locking force of the retainer and to ensure an accurate detection of insufficient insertion. The retainer 30 is provided with locking struts 32 which can enter behind secondary locking portions 26 of terminals 20 in their proper insertion positions. A pair of projections 33 further project from the leading end of each locking strut 32. The two projections 33 are spaced such that a contact portion 21 of the terminal 20 can be held therebetween. If the retainer 30 is pushed to its full lock position after the terminals 20 are inserted, the locking struts 32 enter behind the secondary locking portions 26 while the projections 33 are holding the contact portions 21 therebetween. An engaging area of the retainer 30 with the terminals 20 is increased by providing the projections 33 and, accordingly, a locking force is increased. If the terminals 20 are left insufficiently inserted, the projections 33 at the leading ends of the locking struts 32 come into contact with the side surfaces of covers 22, thereby preventing any further entry of the retainer 30. Since a bulging distance of the retainer 30 is increased by providing the projections 33, the insufficient insertion of the terminals 20 can easily and accurately be detected.

8 Claims, 8 Drawing Sheets

CONNECTOR

BACKGROUND OF THE INVENTION

1. Field of the Invention

The present invention relates to a connector that uses a retainer to lock terminals in their proper insertion positions.

2. Description of the Prior Art

A side retainer type connector, as shown in FIGS. 12(A) and 12(B), includes a housing with cavities 3 into which terminals 2 are insertable. A retainer insertion opening 4 is formed in one side surface of the housing 1 and communicates with the cavities 3. A retainer 5 is provided to enter the retainer insertion opening 4. The terminals 2 are inserted into the cavities 3 with the retainer 5 in its partial lock position, as shown in FIG. 12(A). When the terminals 2 are inserted to their proper positions, metal lances or engaging portions 6 provided on the terminals 2 are engaged with locking portions 7 of the cavities 3, thereby effecting partial locking. Subsequently, the retainer 5 is pushed to its full lock position as shown in solid line in FIG. 12(B), such that locking ends 8 of the retainer 5 engageably enter recesses 9 of the terminals 2 to effect full locking.

In the case that the terminals 2 are insufficiently inserted, the locking ends 8 of the retainer 5 contact the side surfaces of the terminals 2 as shown in phantom line in FIG. 12(B) and prevent movement of the retainer 5 to its full lock position.

With the prior art construction described above, a problem arises if the terminals 2 are small. In particular, the recesses 9 of the terminals 2 are small when the entire terminal is small, and the locking ends 8 of the retainer 5 is correspondingly small. Accordingly, a locking force is inadequate.

In the case that the terminals 2 are insufficiently inserted, the terminals 2 interfere with the entry of the retainer 5, with the result that the retainer 5 bulges from the outer surface of the housing 1. Since a bulging length is short when the terminals 2 are small, it is difficult to detect the insufficient insertion.

The present invention was developed in view of the above problem and an object thereof is to increase a force for locking the terminals and/or make the insufficient insertion of the terminals easily detectable.

SUMMARY OF THE INVENTION

According to the invention, there is provided a connector, comprising a housing and one or more terminals to be substantially inserted into cavities provided in the housing. The connector further includes at least one retainer which is permitted to at least partially enter the cavities sideways or along a direction at an angle different from 0° or 180° with respect to the insertion direction of the terminals. The retainer enters the cavities to lock the terminals so that they do not come out of the cavities when the terminals are in their proper insertion positions. On the other hand, the retainer contacts an insufficiently inserted terminal and is prevented from entering the cavities. One or more projections further project inwardly and are provided at one or more locking ends or portions of the retainer so as not to interfere with terminals that are in their proper insertion positions.

If the retainer is pushed after the terminals are inserted to their proper positions, the locking ends of the retainer formed with the projections lockingly engage the terminals. Since the engaging area is increased by providing the projections, a locking force can be increased.

According to a preferred embodiment of the invention, the one or more projections that further project inwardly are provided at the locking ends or portions of the retainer so as to interfere with the terminals when the terminals are inserted insufficiently. Accordingly, the entry of the retainer is prevented by the inwardly projecting projections coming into contact with the terminals if the terminals are left insufficiently inserted. As a result, the bulging distance of the retainer becomes longer, which makes the insufficient insertion of the terminals easily detectable.

The engaging portions preferably are made of metal and elastically engage the housing. Additionally, the engaging portions project from surfaces of the terminals where the retainer enters, and the projections are formed only in such positions as not to interfere with the engaging portions.

The connector of this type is constructed so that the retainer is partly locked in a position to permit the insertion and withdrawal of the terminals into and from the cavities. In this case, it is desirable that the retainer be partly locked in a position where it is inserted into the housing to a maximum permissible depth so as not to make the housing with the retainer in its partial lock position large. On the other hand, depending upon the type of the terminals, the metal engaging portions for lockingly engaging the housing may project from the surfaces of the terminals where the retainer enters. In the case that such terminals are used, the retainer is partly locked in such a position that the locking ends will not interfere with the metal engaging portions.

Here, if the projections provided at the locking ends of the retainer are, for example, so formed as to project inwardly over the entire width of the locking ends, the projections interfere with the metal engaging portions. In such a case, the insertion of the terminals is permitted by the metal engaging portions moving beyond the projections while undergoing an elastic deformation. However, the temporary restorative deformation of the metal engaging portion upon moving beyond the projection is likely to be misjudged so that the metal engaging portion is lockingly engaged with the housing.

Further, the terminal cannot be withdrawn from the cavity when the projection interferes with the metal engaging portion.

In this respect, since the projections are provided only in positions to avoid interference with the metal engaging portions according to the invention, the metal engaging portions will not engage the projections during the insertion and withdrawal of the terminals even if the retainer is partly locked in a deep position. Accordingly, the above misjudgment caused by the restorative deformation of the metal engaging portions during the insertion of the terminals can be avoided and the terminals can be smoothly withdrawn.

Further preferably, in the case that stabilizers are provided at preferably side edges of the terminals, the projections project into the cavities as the retainer is mounted on the housing in its partial lock position, thereby defining one or more insertion spaces together with side walls of the cavities for allowing the passage of the stabilizers.

By permitting the passage of the stabilizers along the insertion spaces formed at the side of the projections provided on the retainer, the terminals can be inserted and withdrawn more smoothly. Further, in the case that the terminal is mistakenly oriented, it cannot be pushed any further when the front end thereof coming into contact with the projection. Accordingly, an error insertion can also be prevented.

According to a further preferred embodiment, the projections are provided in positions corresponding to a locking recess or hole of the terminal so as to be engageable with this locking recess when the terminals are in their proper insertion positions.

Preferably, the projections are formed on the locking end(s) at positions that are laterally spaced so that when the terminals are in their proper insertion positions, the projections can be inserted into the corresponding cavities without interfering with the terminals and engaging locking portions thereof, while interfering with the terminals, preferably enlarged or intermediate portions thereof, when the terminals are insufficiently inserted.

Most preferably, the terminals are provided with one or more engaging portions for engagement with locking portions of the housing, so that the terminals can be primarily locked upon proper insertion into the cavities, and the retainer provides for a secondary locking for the terminals having a larger locking force when being positioned in its full locking position.

These and other objects, features and advantages of the present invention will become more apparent upon a reading of the following detailed description and accompanying drawings.

DETAILED DESCRIPTION OF THE PREFERRED EMBODIMENTS

Figure 1:
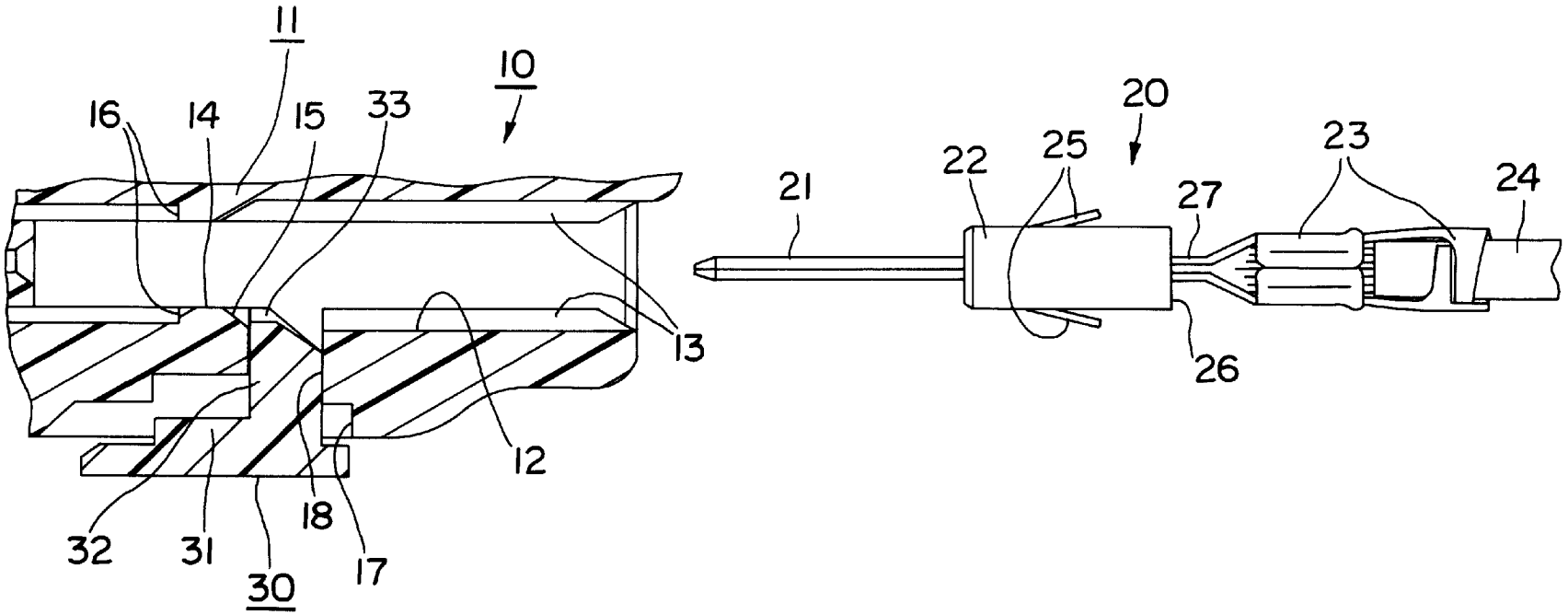
FIG. 1 is a vertical section of a first embodiment of the invention with a retainer partly locked.
Figure 2:
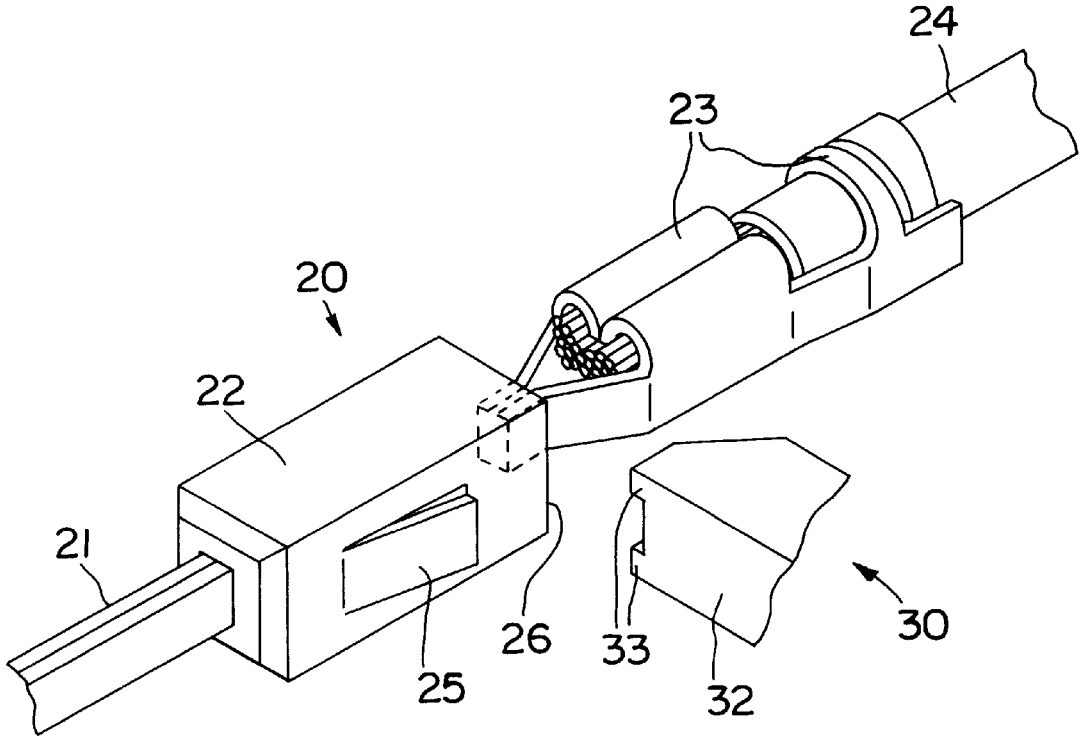
FIG. 2 is a partial perspective view of a terminal and a retainer.

The first embodiment shows a case where the invention is applied to a male connector. A male connector in accordance with a first embodiment of the invention is identified by the numeral 10 in FIGS. 1, 3 and 5. The connector 10 is comprised of a housing 11, terminals 20 insertable into and withdrawable from the housing 11 and a retainer 30 for doubly locking the terminals 20.

The housing 11 is made e.g. of a synthetic resin material and formed with e.g. three cavities 12 for accommodating the terminals 20. The cavities 12 are arranged substantially side by side.

The terminal 20 has a substantially rectangle-tubular cover or intermediate portion or enlarged portion 22 that is integrally or unitarily secured to the outer surface of a base end of a contact portion 21 in the form e.g. of a narrow tab. A barrel portion 23 is provided at the base end of the contact portion 21 and a narrow neck portion 27 extends between the barrel portion 23 and the cross-sectionally larger cover 22. An end of a wire 24 is connected or connectable with the barrel portion 23. One or more metal lances or engaging portions 25 extend obliquely (or at an angle different from 0° or 180° with respect to the cover 22) backward and hang free at rear ends. The metal engaging portions 25 are formed in the lateral, preferably upper and lower surfaces of the cover 22 e.g. by cutting middle portions of the upper and lower surfaces with respect to the widthwise direction and bending the cut portions upward and downward. The metal engaging portions 25 normally bulge outwardly from the cover 22, but are elastically deformable such that they become substantially flush with the outer surfaces of the cover 22.

Lateral surfaces, and preferably upper and lower surfaces of each cavity 12 of the housing 11 have insertion grooves 13 along which the metal engaging portions 25 of the terminal 20 are passable. The insertion grooves 13 preferably are open in the rear surface, and a locking portion 14 is formed in an intermediate position of each insertion groove 13. The rear surface (i.e. the surface at an end which comes first into contact with the terminal 20) of each locking portion 14 is a guide surface 15 which is a tapered surface and the front surface thereof is a locking surface 16 which is a preferably upright surface.

Accordingly, when the terminals 20 are inserted into the corresponding cavities 12 from behind, the metal engaging portions 25 come into contact with the guide surfaces 15 and are deformed elastically to move onto the locking portions 14 while passing along the insertion grooves 13. Upon moving beyond the locking portions 14, the metal engaging portions 25 have their free leading ends lockingly engaged with the locking surfaces 16 while being elastically restored substantially to their original shapes, with the result that the terminals 20 are accommodated in the cavities 12 so as not to come out.

On the other hand, the retainer 30 for doubly locking the terminals 20 accommodated in the cavities 12 is mountable at the lower surface of the housing 11. A retainer recess 17 is formed in the lateral and preferably lower surface of the housing 11 into which the retainer 30 is insertable from a lateral side, and preferably from below substantially over the entire width of the housing 11 in a direction crossing the cavities 12. The retainer insertion cavity 17, and correspondingly the retainer 30 may be dimensioned to extend at least over a width substantially corresponding to the total width of the cavities 12. Individual insertion openings 18 open in the lower surfaces of the respective cavities 12, and specifically in positions behind or opposed to a mating direction of the male connector 10 with a mating female connector (not shown). The locking portions 14 are formed in the upper surface of the retainer insertion recess 17.

The retainer 30 is comprised preferably of a substantially plate-shaped main body 31 which is insertable into the retainer insertion recess 17, and e.g. three locking struts 32 which stand on or project from the upper surface of the main body 31. The locking struts 32 are insertable into the respective insertion openings 18. The upper end portion of each locking strut 32 preferably extends substantially horizontally over a specified width at its front side and then preferably extends substantially obliquely downward toward the rear end.

At the opposite widthwise ends of each locking strut 32 are formed projections 33 projecting further upward. The e.g. two projections 33 are spaced to such an extent that the base end of the contact portion 21 of the terminal 20 can be held or positioned therebetween.

Figure 3:
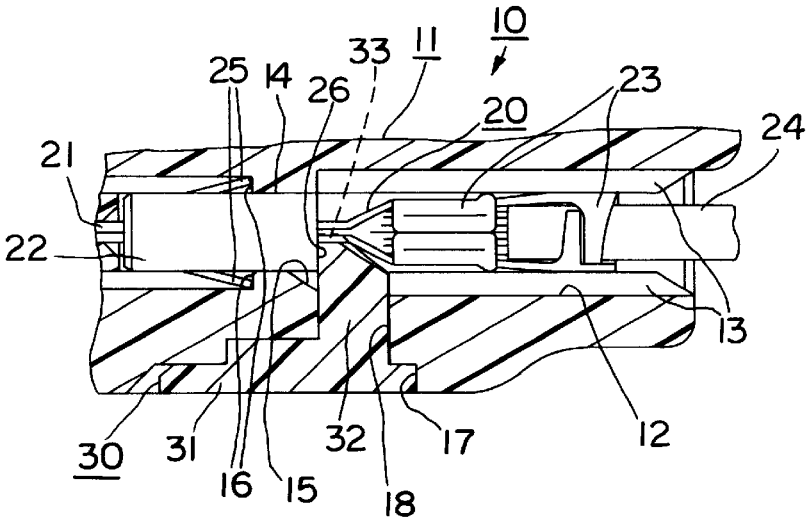
FIG. 3 is a vertical section of the retainer in its full lock position.
Figure 4:
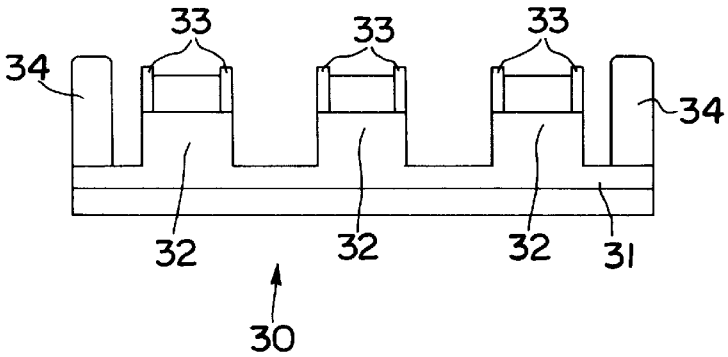
FIG. 4 is a front view of the retainer.

On the other hand, a pair of mount portions 34 project at the opposite longitudinal ends of the main body 31 of the retainer 30 as shown in FIG. 4. The retainer 30 is mounted on a mount means (not shown) provided in the housing 11 via the mount portions 34, and can be held in a partial lock position shown in FIG. 1 and in a full lock position shown in FIG. 3.

With the retainer 30 held in its partial lock position, the upper ends of the projections 33 are located in positions substantially flush with the upper surfaces of the lower locking portions 14, such that the covers 22 of the terminals 20 are allowed to be inserted without coming into contact with the projections 33 of the retainer 30. Further, when the retainer 30 is pushed to the full lock position, the main body 31 is held substantially flush with the lower surface of the housing 11. The upper ends of the respective locking struts 32 then enter the cavities 12 and, particularly, the projections 33 can reach deeper positions while holding the base ends of the terminals 20 therebetween.

The retainer 30 is held in the partial lock position shown in FIG. 1 by being inserted into the retainer insertion recess 17 in the lower surface of the housing 11. Here, the locking struts 32 of the retainer 30 are inserted or fitted into the corresponding insertion openings 18, and the projections 33 provided at the upper ends are located in positions substantially flush with the upper surfaces of the locking portions 14. While the terminals 20 are inserted into the cavities 12 from behind in this state, the metal engaging portions 25 pass along the insertion grooves 13 in their original shapes. Upon moving beyond the retainer 30 in its partial lock position, the metal engaging portions 25 pass the locking portions 14 while undergoing an elastic deformation. When the rear ends of the metal engaging portions 25 move beyond the locking surfaces 16, the metal engaging portions 25 preferably project from the cover 22 due to their elastic restoring forces, thereby engaging the locking surfaces 16.

After the insertion of the terminals 20, the retainer 30 held in its partial lock position is pushed into the housing 11, e.g. upward to the full lock position shown in FIG. 3. Here, if the terminals 20 are properly inserted, the locking struts 32 and projections 33 of the retainer 30 are substantially inserted into the cavities 12 without interference by the covers 22 of the terminals 20. The locking struts 32 and projections 33 then engage secondary locking portions 26 provided at the rear ends of the covers 22 of the terminals 20, with the result that the terminals 20 are doubly locked. The projections 33 result in an increased surface of contact between the terminal 20 and the retainer 30, thereby improving the effectiveness and the locking force of the retainer 30.

Figure 5:
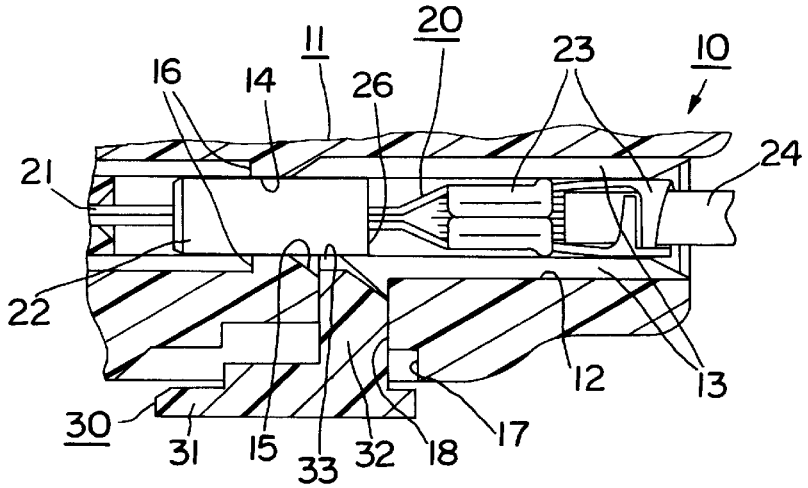
FIG. 5 is a vertical section showing a state where the insufficient insertion of the terminal is detectable.

On the other hand, there is a likelihood that the insertion of the terminals 20 is ended before their proper insertion positions and, accordingly, the terminals 20 are left insufficiently inserted as shown in FIG. 5. In such a case, the projections 33 provided at the upper ends of the locking struts 32 of the retainer 30 come into contact with the side surfaces of the covers 22 of the terminals 20 when an attempt is made to move the retainer 30 from its partial lock position to its full lock position. Thus, the retainer 30 cannot be moved to its full lock position and the main body 31 is bulging out from the lower surface of the housing 11. The bulging length of the retainer 30 at this time is longer by the length of the projections 33 as compared with a retainer not formed with the projections 33. The longer bulging length enables an operator to recognize easily the insufficient insertion of the terminals 20.

As described above, according to this embodiment, the retainer 30 is inserted deep behind the secondary locking portions 26 of the terminals 20 by providing the projections 33 at the upper ends of the locking struts 32 of the retainer 30, thereby more securely preventing the terminals 20 from coming out of the cavities 12. Further, if the terminals 20 are left insufficiently inserted, the upper ends of the locking struts 32 come into contact with the side surfaces of the covers 22 of the terminals 20 when an attempt is made to push the retainer 30 to its full lock position. However, the projections 33 provided at the upper ends of the locking struts 32 come into contact with the cover 22 as described above, and the bulging length of the retainer 30 is increased by the length of the projections 33, i.e. the main body 31 of the retainer 30 bulges out to a large extent from the lower surface of the housing 11. As a result, an operator can easily recognize the insufficient insertion of the terminals 20.

The projections 33 provided on the retainer 30 are located in positions where they are not engageable with the metal engaging portions 25 of the terminals 20 when the retainer 30 is in its partial lock position. Consequently there is no likelihood of misjudging that the metal engaging portions 25 are engaged with the locking surfaces 16 of the cavities 12 when they are actually engaged with the projections 33. In addition, the metal engaging portions 25 do not interfere when the terminals 20 are withdrawn.

A second embodiment of the invention is described with reference to FIGS. 6 to 11. The second embodiment shows a case where the invention is applied to a connector of the type in which a retainer locks terminals by being inserted obliquely from behind with respect to one side surface of a housing. A female connector 40 according to this embodiment is comprised of a housing 41, terminals 50 and a retainer 60 as shown in FIG. 8.

Figure 6:
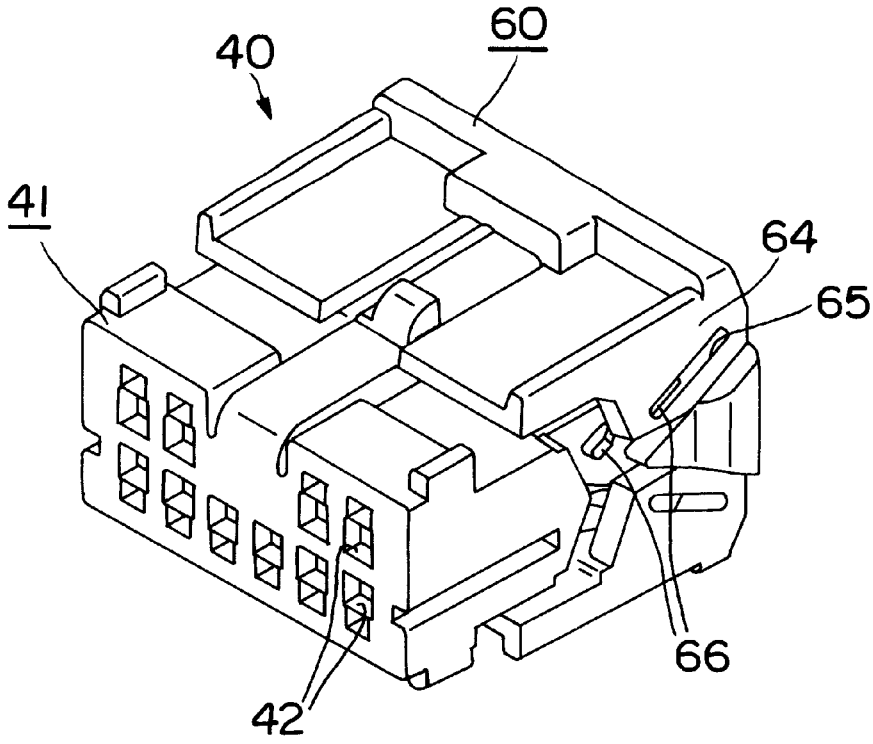
FIG. 6 is a perspective view of a connector according to a second embodiment of the invention.

As shown in FIG. 6, the housing 41 made e.g. of a synthetic resin material is formed with a total of e.g. ten cavities 42 into which terminals 50 are insertable: six in the lower level and two each at the opposite sides of the upper level. Since the cavities 42 are symmetrically shaped with respect to vertical direction, only those in the upper level are described herebelow.

The terminal 50 has a double structure in which a contact portion 52 preferably is covered by a substantially rectangle-tubular cover 51, and an end of a wire 53 is connected with a barrel portion 52A provided at a rear end of the contact portion 52. A metal engaging portion 54 is provided on the lateral, preferably upper surface of the cover 51. The metal engaging portion 54 is formed e.g. by cutting a middle portion of the upper surface with respect to widthwise direction and bending the cut portion upward, to extend obliquely (or at an angle different from 0° or 180° with respect to the cover 51) backward and hang free at its rear end. Although normally bulging outward of the cover 51, the metal engaging portion 54 is elastically deformable such that it becomes substantially flush with the outer surface of the cover 22. A rear end portion of the upper surface of the cover 51 preferably is cut away to define a secondary locking hole 56 opening upward.

On the lateral, preferably upper wall of each cavity 42 of the housing 41, a restricting piece 43 is formed at a specified spacing from at least one side wall (left wall in FIG. 9) and substantially along the longitudinal direction. This spacing defines an insertion groove 44 along which a stabilizer 55 of the terminal 50 is insertable. An engaging portion 45 is also formed on the upper wall of the cavity 42. An angle of the engaging portion 45 between the rear surface and the lower surface is cut off to form a slanting guide surface 46, and the front surface thereof is at a substantially right angle to the lower surface to form a locking hole 47 which is open to the outside.

Accordingly, while the terminal 50 is inserted into the corresponding cavity 42 from behind, the metal engaging portion 54 comes into contact with the guide surface 46, thereby moving onto the engaging portion 45 while being elastically deformed inwardly. While the metal engaging portion 54 is restored to its original shape upon moving beyond the engaging portion 45, the leading end thereof engages the lock hole 47, with the result that the terminal 50 is so accommodated or locked as not to come out of the cavity 42.

A retainer insertion recess 48 is formed in the lateral, preferably upper surface of the housing 41. The retainer 60 is insertable into the recess 48 in an oblique direction or a direction at an angle different from 0° or 180° with respect to the insertion direction of the terminal 50 into the housing 41, preferably from the upper right side. The retainer insertion recess 48 preferably extends substantially over the entire width of the housing 41 in a direction crossing or intersecting the cavities 42. Insertion openings 49 are individually open in the upper surfaces of the respective cavities 42, specifically in positions behind the guide surfaces 46, and are formed in the upper surface of the retainer insertion recess 48.

Figure 7:
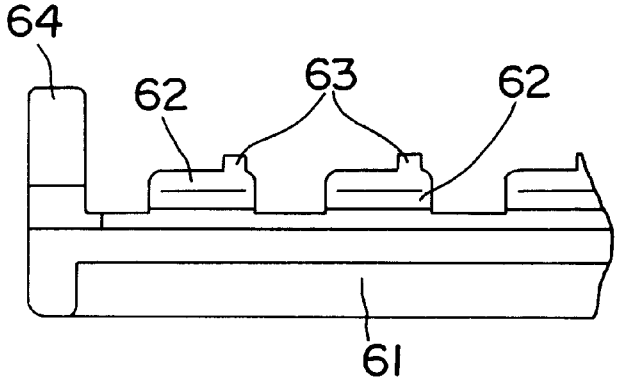
FIG. 7 is a partial front view of a retainer.
Figure 8:
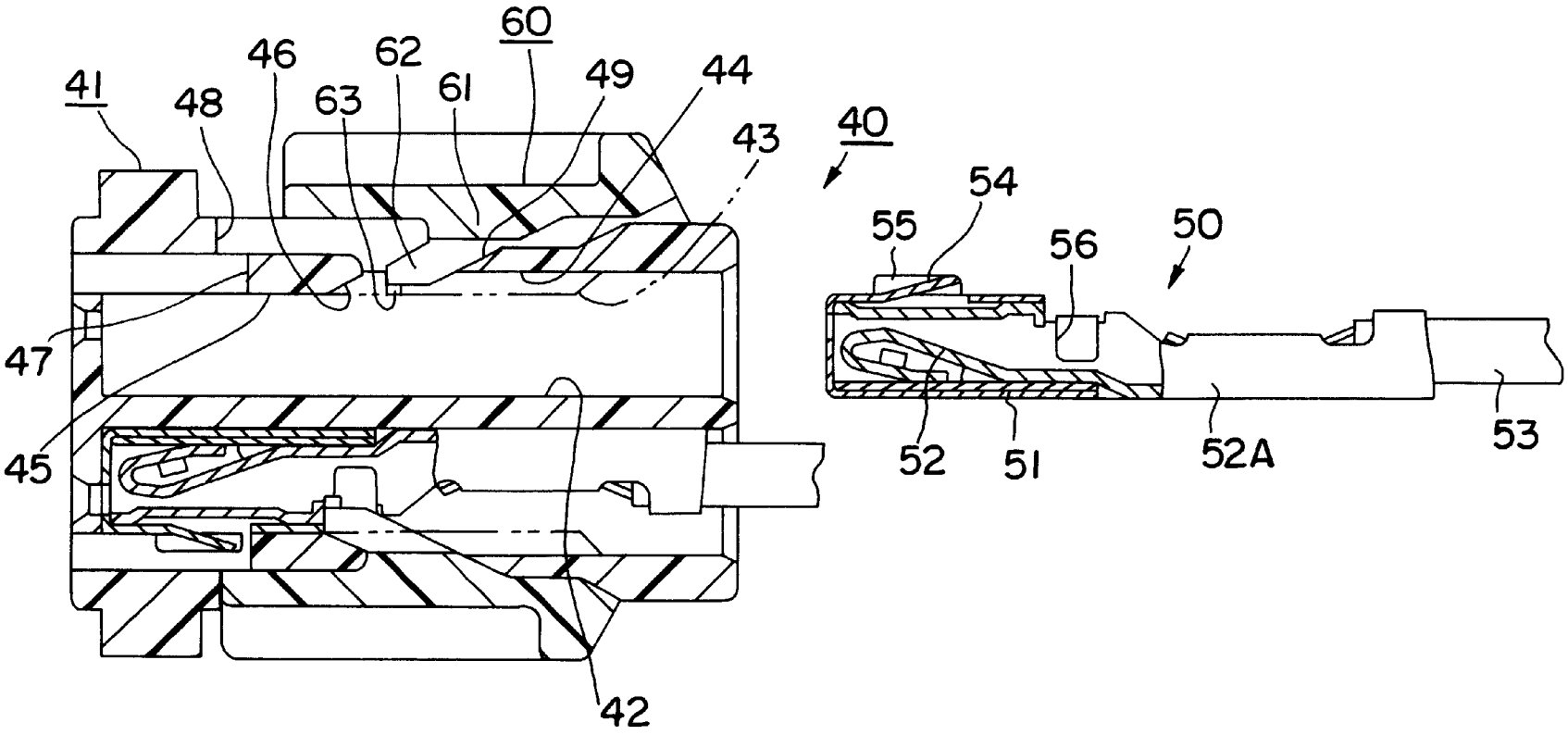
FIG. 8 is a vertical section showing the insertion of the terminal.

The retainer 60, as shown in FIG. 7, is comprised of a substantially plate-shaped main body 61 insertable into the retainer insertion recess 48 and one or more locking portions 62 which are formed on the surface of the main body 61 on the side of the connector 40, preferably on the lower surface, and substantially insertable or fittable into the respective insertion openings 49. The locking portions 62 project obliquely forward from the main body 61, i.e. at an angle different from 0° or 180° with respect to the longitudinal direction of the terminals 50.

At one widthwise end of the leading end of each locking portion 62 (a side opposite from the side corresponding to the restricting piece 43 of the cavity 42) is formed at least projection 63 projecting further downward or a direction toward the housing 41. In other words, the at least one projection 63 projects from the distal end of the locking portion 62 in a projecting direction thereof.

Opposite longitudinal ends of the main body 61 of the retainer 60 are provided with mount plates 64 projecting downward. The mount plates 64 are each formed with a mount groove 65 in the form e.g. of an oblong hole. On the other hand, a pair of mount projections 66 are provided on the outer surface of the side wall of the housing 41. The retainer 60 is displaceable in an oblique direction and can be held in a partial lock position (see FIG. 8) where one mount projection 66 is fitted in the mount groove 65 and in a full lock position where both mount projections 66 are fitted in the mount groove 65 by further pushing the retainer 60.

With the retainer 60 held in the partial lock position shown in FIG. 8, the leading ends of the locking portions 62 including the projections 63 project into the cavities 42 by a specified (predetermined or predeterminable) distance. A clearance or insertion space 67 (FIG. 9) is defined between each projection 63 and the side wall in proximity to which the restricting piece 43 is provided. The clearance or insertion space 67 is provided to receive another stabilizer 55 of the terminal 50. The projection 63 preferably projects down substantially as much as the restricting piece 43. The metal engaging portion 54 of the terminal 50 can pass between the restricting piece 43 and the projection 63 without interference by them.

Figure 10:
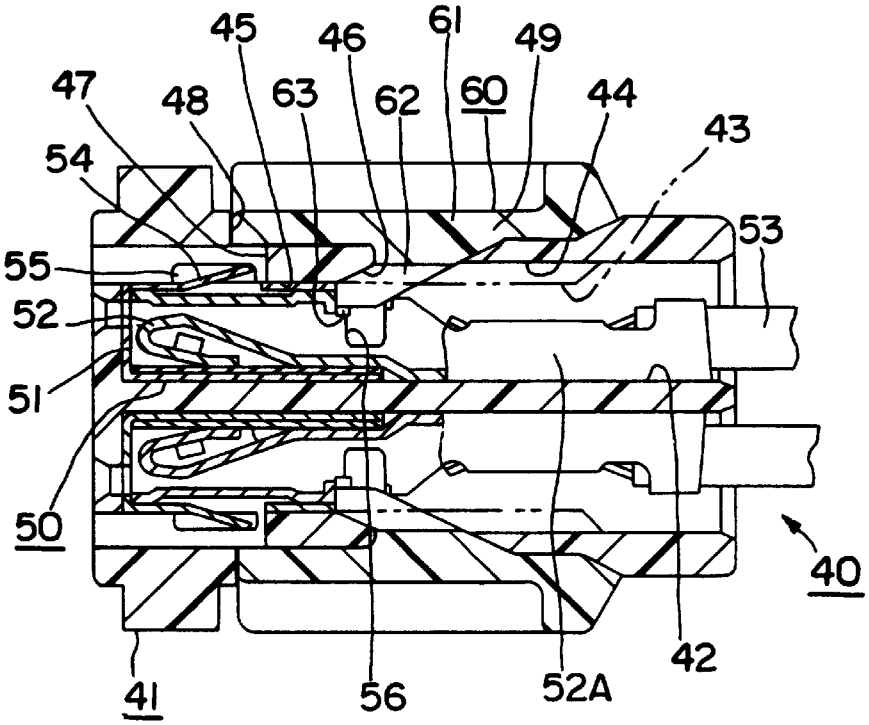
FIG. 10 is a vertical section of the retainer fully locked.

When the retainer 60 is pushed to the full lock position shown in FIG. 10, the leading ends of the locking portions 62 including the projections 63 can enter the secondary locking hole 56 of the terminals 50 inserted to their proper positions.

Figure 9:
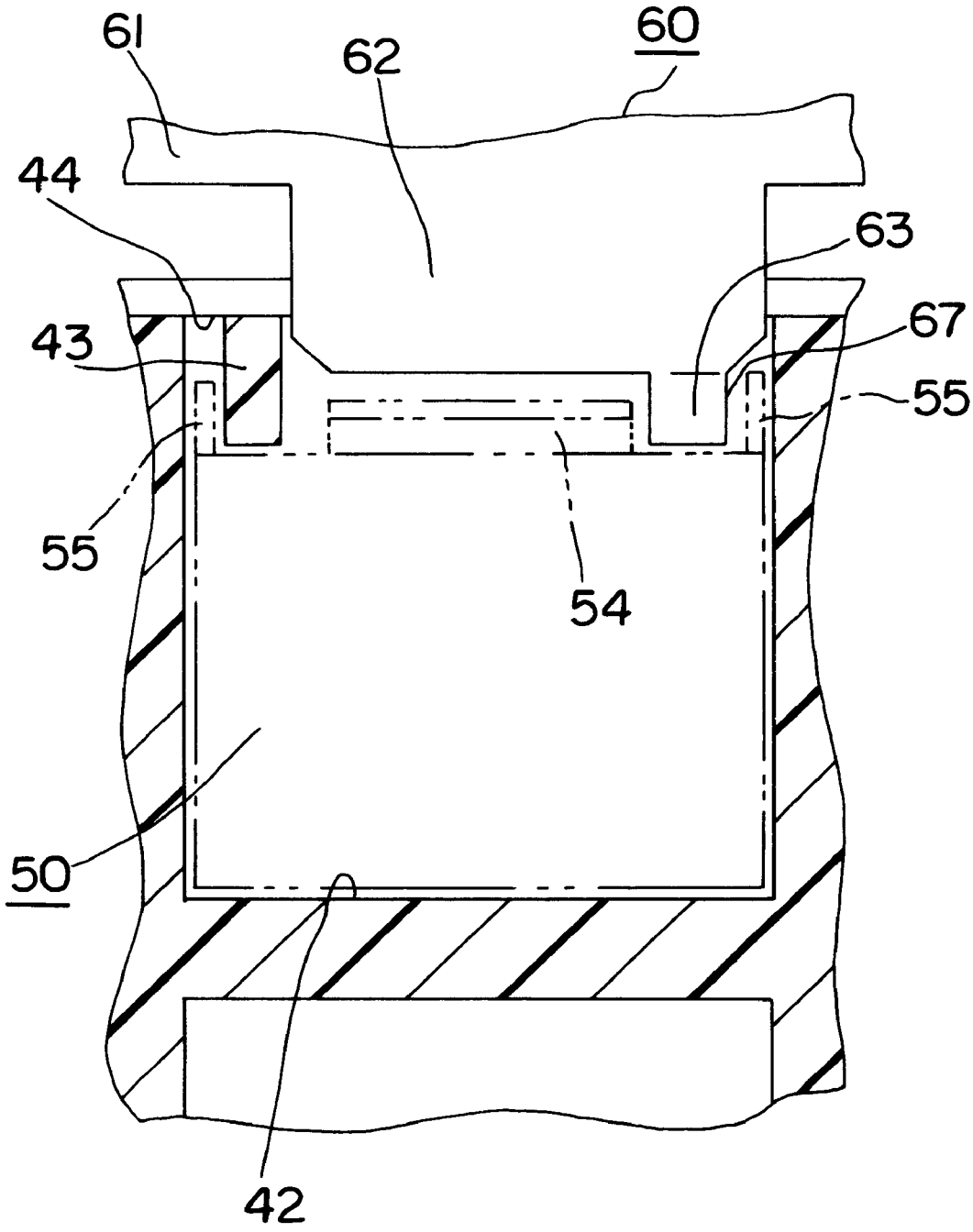
FIG. 9 is a partial horizontal section of a retainer partly locked.

The retainer 60 is mounted substantially on the housing 41 in the partial lock position shown in FIGS. 8 and 9. At this time, the projections 63 of the locking portions 62 are held in positions substantially pairing with the restricting pieces 43, thereby defining, together with the side walls of the cavities 42, the clearances 67 (see FIG. 9) for permitting the insertion of the stabilizers 55. When the terminals 50 are inserted into the cavities 42 from behind, the left and right stabilizers 55 thereof pass along the insertion grooves 44 outside the restricting pieces 43 and along the clearances 67 outside the projections 63, and the metal engaging portions 54 pass between the restricting pieces 43 and the projections 63 without interference. Here, if the terminal 50 is inserted while being held upside-down, the front end of the cover 51 comes into contact with the restricting piece 43 and the terminal 50 cannot be inserted any further. In other words, an error insertion of the terminal 50 can be prevented.

When the metal engaging portion 54 comes into contact with the guide surface 46 formed on the upper surface of the cavity 42 during the insertion, the terminal 50 is pushed further in while the metal engaging portion 54 substantially undergoes an elastic deformation. When the projecting end of the metal engaging portion 54 reaches the locking hole 47 after passing the engaging portion 45, the metal engaging portion 54 is restored to its original shape and fitted in the locking hole 47, with the result that the primary locking of the terminal 50 is effected.

After the insertion of the terminal 50, the retainer 60 is pushed to the full lock position shown in FIG. 10. At this time, if the terminals 50 are properly inserted, the locking portions 62 and the projections 63 of the retainer 60 substantially enter the secondary locking holes 56 without coming into contact with the covers 51 of the terminals 50, with the result that the secondary locking of the terminals 50 is effected. Since the projections 63 are provided at the leading ends of the locking portions 62, the terminals 50 are held in the cavities 42 with a stronger force.

Figure 11:
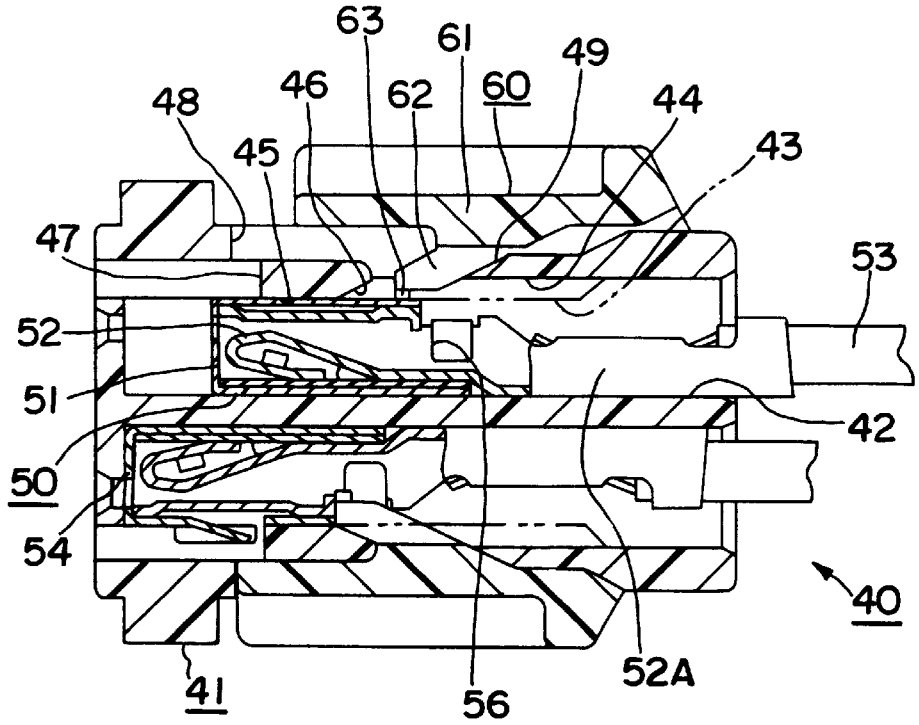
FIG. 11 is vertical section showing a state where the insufficient insertion of the terminal is detectable.
Figure 12A:
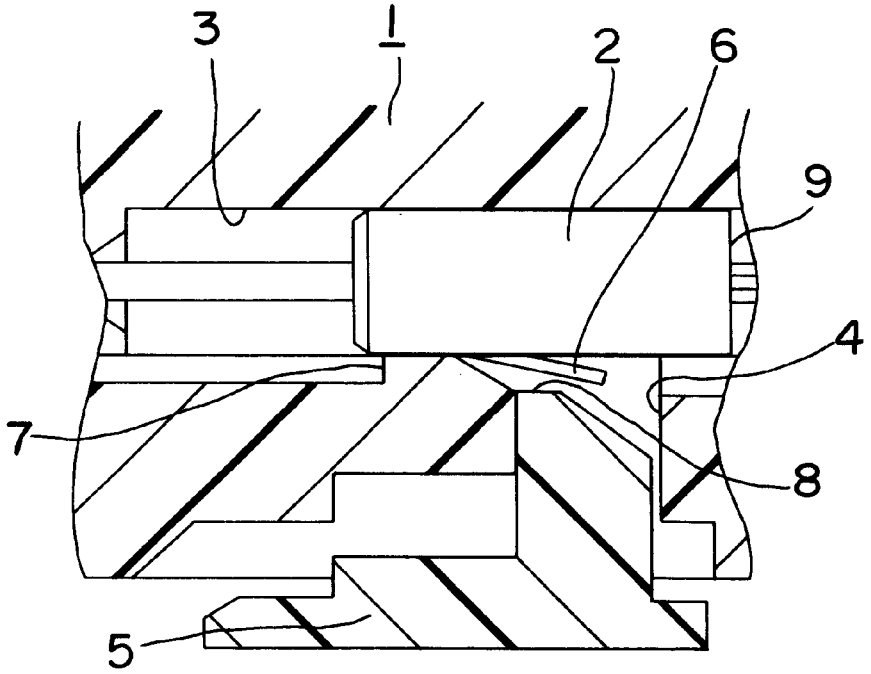
FIG. 12A PRIOR ART
FIG. 12 is a partial vertical section of a prior art connector.
Figure 12B:
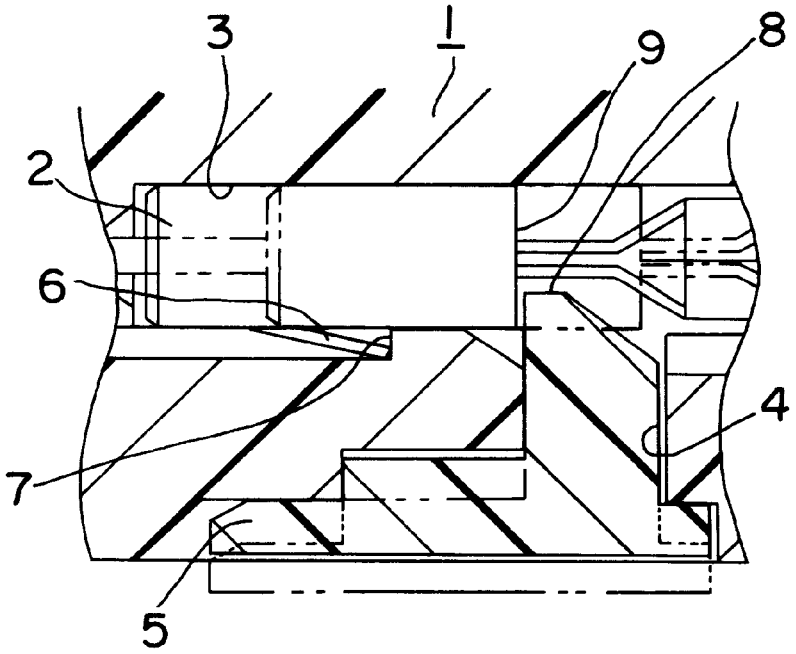
FIG. 12B PRIOR ART

The terminals 50 may be left insufficiently inserted as shown in the upper level of FIG. 11 by the insertion being ended before the terminals 50 reach their proper insertion positions. In such a case, if an attempt is made to push the retainer 60 to its full lock position, the projections 63 provided on the locking portions 62 of the retainer 60 come into contact with the covers 51 of the terminals 50. Accordingly, the retainer 60 cannot be moved to its full lock position, thereby bulging out from the upper surface of the housing 41. The bulging length of the retainer 60 at this time is longer by the length of the projections 63 as compared with a retainer not formed with the projections 63. The longer bulging length enables an operator to recognize easily the insufficient insertion of the terminals 50.

As described above, the projections 63 at the leading ends of the locking portions 62 of the retainer 60, enable the retainer 60 to engage the terminals 50 in an enlarged area when the locking portions 62 enter the secondary locking holes 56 upon the movement of the retainer 60 to its full lock position. In other words, the terminals 50 can be held with a larger locking force. Further, in the case that the terminals 50 are left insufficiently inserted, the leading ends of the locking portions 62 come into contact with the covers 51 of the terminals 50 when an attempt is made to push the retainer 60 to its full lock position. Since the projections 63 provided at the upper ends of the locking portions 62 as described above come into contact with the covers 51, the bulging length of the retainer 60 is increased by the length of the projections 63, i.e. the retainer 60 bulges out from the outer surface of the housing 41 by a longer distance. As a result, an operator can easily recognize the insufficient insertion of the terminals 50.

Since the projections 63 provided on the retainer 60 are located in positions where they are not engageable with the metal engaging portions 54 of the terminals 50 when the retainer 60 is in its partial lock position, there is no likelihood of misjudging that the metal engaging portions 54 are engaged with the lock holes 47 of the cavities 47 when they are actually engaged with the projections 63. In addition, the metal engaging portions 54 do not interfere when the terminals 50 are withdrawn.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

In the second embodiment, a pair of projections may be provided at the leading end of each locking portion of the retainer by omitting the restricting pieces provided in the cavities. In such a case, if the two projections are so provided as to define such clearances between the projections and the corresponding side walls as to permit the insertion of the stabilizers, it prevents the insertion of the terminals held upside-down and a smooth insertion of the terminals can be expected.

The shape and positions of the projections of the retainer may be suitably changed according to the shape of the secondary locking portions of the terminals.

What is claimed is:

1. A connector, comprising:

a housing having opposed rearward and forward ends and a plurality of cavities extending through the housing from the rearward end to the forward end, a retainer insertion recess extending transversely into the housing at a location between the rearward and forward ends, a plurality of insertion openings extending from the retainer insertion recess into the respective cavities, and a forwardly facing locking surface formed in each said cavity at a location forwardly of the respective insertion openings, terminals for insertion into the respective cavities in the housing from the rearward end of the housing along an insertion direction, each said terminal having a cover with a selected width, each said cover having a rearwardly facing end surface and having an engaging projection extending rearwardly and obliquely outwardly on the cover for engaging the locking surface of the housing when the rearwardly facing surface of the cover is substantially adjacent the insertion opening into the cavity, the engaging portion defining a width less than the width of the cover, and at least one retainer having a main body configured to at least partially enter the retainer insertion recess along a direction at an angle different from 0° and 180° with respect to the insertion direction of the terminals, the retainer having a plurality of locking struts projecting from the main body of the retainer and into the respective insertion openings, the retainer being selectively movable between a partial lock position and a full lock position, the locking struts being dimensioned for entering the cavities when the terminals are fully inserted and when the retainer is in the full lock position such that the locking struts engage the rear face of the cover of each said terminal to lock the terminals so that the terminals do not come out of the cavities when the terminals are in proper insertion positions, the locking struts of the retainer being configured for contacting the covers of the respective terminals when the terminals are insufficiently inserted, at least one projection projecting inwardly at ends of the respective locking struts opposite the main body of the retainer, each said projection defining a width less than a difference between the width of the cover and the width of the respective engaging portion of the terminal inserted into the respective cavity, said projections further being disposed on the respective locking struts in such positions to avoid interference with the engaging portions of the respective terminals during insertion of the respective terminals into their proper insertion positions, said projections further being configured to contact portions of the rear face of the cover for further locking the respective terminals in the cavities of the housing after full insertion of the respective terminals and insertion of the retainer to the full locked position.

2. A connector according to claim 1, wherein the projections are configured to interfere with the terminals when the terminals are insufficiently inserted.

3. A connector according to claim 2, wherein stabilizers are provided at side edges of the terminals, the projections project into the cavities as the retainer is mounted on the housing in its partial lock position, thereby defining one or more insertion spaces together with side walls of the cavities for allowing the passage of the stabilizers.

4. A connector according to claim 1, wherein the engaging portion of each said terminal is located centrally between the sides of the cover of the respective terminal, each said locking strut of the retainer having a pair of said projections, said projections being spaced apart and dimensioned to permit the engaging portion of the respective terminal to slide between the projections of the locking strut in the respective cavity when the retainer is in the partial locked position and during the insertion of the respective terminal into the respective cavity.

5. A connector comprising:

a housing having opposed rearward and forward ends and a plurality of cavities extending substantially parallel to one another through the housing from the rearward end to the forward end, a retainer insertion recess extending transversely into the housing and a plurality of insertion openings extending from the retainer insertion recess into the respective cavities, each said cavity having a forwardly facing locking surface disposed forwardly of the respective insertion opening;

a plurality of terminals dimensioned for insertion forwardly along an insertion direction into the respective cavities of the housing, each said terminal having at least one resiliently deflectable engaging portion projecting rearwardly and obliquely outwardly for locking engagement with the locking surface of the respective cavity when the terminal has been fully inserted, each said terminal further having a rearwardly facing engagement surface rearwardly of the engaging portion and disposed to be forwardly of and adjacent to the insertion opening of the housing when the terminal has been fully inserted; and a retainer having a main body configured for insertion transversely into the retainer insertion recess of the housing and being movable from a partially locked position to a fully locked position, a plurality of locking struts projecting from the main body, the locking struts being dimensioned and disposed for passage through the respective insertion openings and into the respective cavities when the retainer is in the fully locked position, ends of the locking struts remote from the main body being of stepped configuration to define at least one projection, said projections being dimensioned and disposed to project into the cavities when the retainer is in the partially locked position, but being at locations in the cavities to prevent interference with the resiliently deflectable engaging portions during insertion of the terminals and when the retainer is in the partially locked position, the projections further being dimensioned and disposed for engaging the rearward engagement face of the terminal when the terminal is fully inserted into the cavity and when the retainer is in a fully locked position in the housing.

6. A connector comprising:

a housing having opposed rearward and forward ends and a plurality of cavities extending substantially parallel to one another through the housing from the rearward end to the forward end, a retainer insertion recess extending transversely into the housing and a plurality of insertion openings extending from the retainer insertion recess into the respective cavities;

a plurality of terminals dimensioned for insertion forwardly along an insertion direction into the respective cavities of the housing, each said terminal having a forward end defining a contact portion for mating with another terminal and a rear end defining a barrel portion for connection to a wire, an enlarged cover portion disposed between the contact portion and the barrel and a neck defined between the cover portion and the barrel, the neck being cross-sectionally smaller than the cover portion such that the cover portion defines a rearwardly facing engagement surface adjacent said neck and disposed to be forwardly of and adjacent to the insertion opening of the housing when the terminal has been fully inserted; and a retainer having a main body configured for insertion transversely into the retainer insertion recess of the housing and being movable from a partially locked position to a fully locked position, a plurality of locking struts projecting from the main body, the locking struts being dimensioned and disposed for passage through insertion openings and into the respective cavities when the retainer is in the fully locked position, ends of the locking struts remote from the main body being of stepped configuration to define at least one projection, said projections being dimensioned and disposed to pass adjacent the neck of the respective terminal and to engage the rearwardly facing engagement surface of the cover portion when the terminal is fully inserted into the cavity and when the retainer is in the fully locked position in the housing.

7. A connector according to claim 6, wherein said at least one projection comprises a pair of projections spaced from one another sufficiently for passing on opposite sides of the neck of the terminal fitting.

8. A connector according to claim 7, wherein the housing comprises a forwardly facing locking surface formed in each said cavity at a location forwardly of the respective insertion openings, each said terminal further comprising an engaging projection extending rearwardly and obliquely outwardly on the cover portion for locked engagement with the locking surface of the housing when the terminal is fully inserted into the housing, the projections on the locking struts of the retainer being spaced sufficiently from one another to prevent interference with the resiliently deflectable engaging portion during insertion of the terminals into the housing.

* * * * *